US010553097B2

(12) United States Patent
Arinze

(10) Patent No.: US 10,553,097 B2
(45) Date of Patent: Feb. 4, 2020

(54) INTERACTIVE SMART SEAT SYSTEM

(71) Applicant: Chukwunoso Arinze, Chicago, IL (US)

(72) Inventor: Chukwunoso Arinze, Chicago, IL (US)

( * ) Notice: Subject to any disclaimer, the term of this patent is extended or adjusted under 35 U.S.C. 154(b) by 0 days.

(21) Appl. No.: 16/184,830

(22) Filed: Nov. 8, 2018

(65) Prior Publication Data

US 2019/0139386 A1 May 9, 2019

Related U.S. Application Data

(60) Provisional application No. 62/583,726, filed on Nov. 9, 2017.

(51) Int. Cl.
*G08B 21/02* (2006.01)
*A47C 7/72* (2006.01)

(52) U.S. Cl.
CPC ..... *G08B 21/02* (2013.01); *A47C 7/72* (2013.01); *A61H 2201/5064* (2013.01); *A61H 2201/5071* (2013.01); *A61H 2201/5082* (2013.01); *A61H 2201/5084* (2013.01); *A61H 2201/5097* (2013.01)

(58) Field of Classification Search
None
See application file for complete search history.

(56) References Cited

U.S. PATENT DOCUMENTS 5,195,369 A * 3/1993 Bux ..... G01M 1/28 340/870.16
5,930,152 A * 7/1999 Dumont ..... B60N 2/0224 700/302
5,975,508 A * 11/1999 Beard ..... B60N 2/501 180/89.12
6,050,407 A * 4/2000 Trujillo ..... H01H 9/0242 206/320
6,271,760 B1 * 8/2001 Watanabe ..... B60N 2/002 340/665
6,348,663 B1 * 2/2002 Schoos ..... B60N 2/002 177/144
6,385,517 B1 * 5/2002 Kore ..... B60N 2/002 701/45
6,494,284 B1 * 12/2002 Cooper ..... B60N 2/002 180/282
7,063,352 B2 * 6/2006 Kumakiri ..... B60R 21/01532 180/273
7,230,530 B1 * 6/2007 Almquist ..... B60N 2/002 180/271
9,795,322 B1 * 10/2017 Karunaratne ..... A47C 7/72
2001/0040056 A1 * 11/2001 Schoos ..... B60N 2/002 177/144
2002/0067064 A1 * 6/2002 Jaillet ..... B32B 5/18 297/452.27

(Continued)

*Primary Examiner* — Curtis J King
(74) *Attorney, Agent, or Firm* — Foley & Lardner LLP

(57) ABSTRACT

Implementations of systems and methods to facilitate interactions associated with the health of a child with a caretaker of the child are described. One implementation of a system comprises a seating receptacle removably connectable to a base, a battery configured to independently power the receptacle when separated from the base, and one or more processors. The one or more processors may be operably connected to one or more of a piezoelectric sensor configured to sense respiration, a weight sensor configured to sense posture, a camera, a storage device, and/or a network interface.

11 Claims, 4 Drawing Sheets

(56) References Cited

U.S. PATENT DOCUMENTS

2003/0060957 A1* 3/2003 Okamura ..... B60N 2/002 701/45
2003/0188908 A1* 10/2003 Abe ..... B60R 21/045 180/282
2004/0056520 A1* 3/2004 Cho ..... A47C 7/405 297/218.1
2004/0165117 A1* 8/2004 Shibusawa ..... H04N 5/50 348/734
2004/0165739 A1* 8/2004 Akens ..... H04R 1/20 381/189
2005/0098998 A1* 5/2005 Kohama ..... B60R 22/30 280/808
2005/0140210 A1* 6/2005 Kojima ..... B60N 2/002 307/10.1
2005/0275260 A1* 12/2005 Patterson ..... B60N 2/002 297/256.16
2006/0125785 A1* 6/2006 McAlindon ..... G06F 3/0235 345/156
2007/0075574 A1* 4/2007 James ..... B60N 2/002 297/217.3
2007/0102999 A1* 5/2007 Darraba ..... B60N 2/002 307/10.1
2007/0200721 A1* 8/2007 Stanley ..... B60R 21/01532 340/667
2007/0241895 A1* 10/2007 Morgan ..... B60N 2/002 340/561
2008/0103702 A1* 5/2008 Ando ..... A61B 5/103 702/41
2008/0176466 A1* 7/2008 Parten ..... B63B 21/58 441/65
2009/0040055 A1* 2/2009 Hattori ..... A61M 21/02 340/576
2009/0231145 A1* 9/2009 Wada ..... A61B 5/02416 340/575
2009/0289529 A1* 11/2009 Ito ..... G01L 1/16 310/365
2009/0318227 A1* 12/2009 Nakajima ..... A63F 13/02 463/35
2010/0002115 A1* 1/2010 Liu ..... H01L 27/14634 348/308
2010/0033331 A1* 2/2010 Bautovich ..... A61B 5/1116 340/573.1
2010/0148548 A1* 6/2010 Nakagawa ..... B60N 2/002 297/217.1
2011/0301782 A1* 12/2011 Yamamoto ..... B60N 2/002 701/1
2012/0299339 A1* 11/2012 Birch ..... A01M 31/02 297/188.01
2013/0072767 A1* 3/2013 Imamura ..... A61B 5/024 600/301
2014/0309035 A1* 10/2014 Crawford ..... A63F 13/803 463/36
2016/0257272 A1* 9/2016 Ruthinowski ..... B60R 21/01512
2017/0020432 A1* 1/2017 Kusukame ..... A61B 5/18
2017/0106768 A1* 4/2017 Curtis ..... B60N 2/002
2017/0327124 A1* 11/2017 Kim ..... B60N 2/002
2018/0037137 A1* 2/2018 Goedert ..... B60N 2/5685
2018/0056814 A1* 3/2018 Tanyi ..... B60N 2/002
2018/0079321 A1* 3/2018 Sugiyama ..... B60N 2/90
2018/0118064 A1* 5/2018 Sato ..... B60N 2/002
2018/0118071 A1* 5/2018 Sugiyama ..... B60N 2/90
2018/0134118 A1* 5/2018 Hintea ..... B60H 1/00742
2018/0251031 A1* 9/2018 Liebau ..... B60K 37/02
2018/0262719 A1* 9/2018 Jo ..... H04N 5/247
2019/0098558 A1* 3/2019 Yanagida ..... H04W 16/26

* cited by examiner

INTERACTIVE SMART SEAT SYSTEM

CROSS REFERENCE TO RELATED APPLICATIONS

This application claims the benefit of U.S. Provisional Application No. 62/583,726 filed Nov. 9, 2017, which is hereby incorporated by reference in its entirety.

FIELD

The present application relates generally to the field of personal assistants and child monitoring devices.

BACKGROUND

Most children are unable to communicate health information to their parents and custodians (hereinafter referred to as "caretakers") or protect themselves from hazardous situations. For example, children's medicine is administered specifically by weight and caretakers may not be aware that a weight threshold has been passed. Caretakers must also be aware of feeding needs and hunger patterns. An example of when a child is vulnerable and unable to protect themselves is when a child is left in hot places like a car where heatstroke or other causes may result in severe injury or death to the child. Another problem with communication between children and caretakers is that children may not have developed communication skills to convey a problem that can be solved quickly and efficiently. In other words, any communication of his or her health may be one-way where a child indicates something is wrong, but further attempts at communication does not verify that the caretaker is addressing the proper issue. This may be referred to as one-way communication as opposed to two-way communication.

SUMMARY

Various implementations relate to systems and methods to facilitate interactions associated with the health of a child with a caretaker of the child. One implementation of a system comprises a seating receptacle removably connectable to a base, a battery configured to independently power the receptacle when separated from the base, and one or more processors. The one or more processors may be operably connected to one or more of a piezoelectric sensor configured to sense respiration, a weight sensor configured to sense posture, storage device, and/or a network interface.

In some implementations, the weight sensor further comprises a flexible material coupled to a top external surface of the receptacle configured to be between an occupant and the top external surface of the receptacle, and a plurality of piezoelectric sensor cells coupled to the flexible material. The plurality of piezoelectric sensor cells may be configured in a grid pattern to measure localized strain for determining the sitting posture of the occupant. The one or more processors may be configured to receive a plurality of signals from the plurality of piezoelectric sensor cells, determine localized strain from the plurality of signals, and determine a sitting posture of an occupant of the seating receptacle based on the localized strain.

In some implementations, the system further comprises an accelerometer operably connected to the one or more processors and configured to send signals indicative of breathing patterns of an occupant to the one or more processors.

Other implementations relate to methods to facilitate interactions associated with the health of a child with a caretaker of the child. In some implementations, the methods may execute on the one or more processors of the system implementations above. In one implementation, a method comprises receiving an input indicative of an occupancy of a seating receptacle, receiving data from a sensor coupled to the receptacle, transmitting an output of a first output type based on the received data from the sensor, receiving a first input consequent to transmitting the output of the first output type, comparing a number or frequency of inputs including the first input consequent to transmitting the first output to a threshold number or frequency of inputs, determining the number or frequency of inputs including the first input does not meet the threshold number or frequency of inputs, and transmitting an output of a second output type based on the determination, wherein the second output type is different than the first output type.

In some implementations, the method further comprises receiving a second input consequent to transmitting the second output type, comparing a number or frequency of inputs responsive to outputs of the second output type including the second input to the threshold number of inputs, and determining the number or frequency of inputs responsive to outputs of the second output type including the second input meets the threshold number of inputs. In some implementations, the method further comprises determining the data is indicative of distress of an occupant of the seating receptacle and transmitting an alert using the second output type consequent to determining the number or frequency of inputs responsive to outputs of the second output type including the second input meets the threshold number of inputs. In some implementations, the method further comprises accessing an online database, comparing the received data to data from the accessed online database, and determining an occupant of the seating receptacle is potentially in distress based on the comparison. In some implementations, the method further comprises comparing the received data to a predetermined parameter, determining the received data is outside of the predetermined parameter, and outputting a signal indicative of an alert based on the determination.

Other implementations relate to non-transitory computer-readable medium comprising instructions, wherein the instructions execute on one or more processors to execute one or more of the methods above.

In some implementations, of the above systems and methods, the sensor is one of a microphone, a camera, a weight sensor, or a thermometer. In some implementations including a piezoelectric sensor, the piezoelectric is configured to fasten to a restraining device configured to restrain an occupant of the seating receptacle, contact the occupant across the abdominal region, and send signals indicative of strain of the piezoelectric sensor from expansion resulting from breathing of the occupant to the one or more processors. In some implementations, one or more thermometers is operably connected to the one or more processors. The one or more thermometers may be configured to read a body temperature of an occupant of the seating receptacle and an ambient temperature. In some implementations, a motion sensor is operably connected to the one or more processors. In some implementations the one or more processors is configured to receive an input indicating occupancy of the seating receptacle from a weight sensor.

This summary is illustrative only and is not intended to be in any way limiting. Other aspects, inventive features, and advantages of the devices and/or processes described herein, as defined solely by the claims, will become apparent in the detailed description set forth herein, taken in conjunction with the accompanying figures, wherein like reference numerals refer to like elements.

DETAILED DESCRIPTION

Often, parents, babysitters, or other caretakers use various devices to monitor the health of the child in their custody because most children cannot communicate their needs, regardless of degree of imminent or possible harm, to the caretaker. For example, a child may be crying but cannot indicate what is the cause of their crying.

In addition to many children not being able to communicate their health and safety concerns, there are psychological barriers that may, in some circumstances, prevent caretakers from being proactive to reduce the risk of dangerous incidents because the caretaker of a child does not believe that he or she could commit such a mistake. As a result, devices where the sole purpose of the device is to remind or warn of a specific dangerous situation may be less likely to be used. Further, warnings and alerts that are constantly being deployed do not incite a reaction in a caretaker that may be adequate for the level of danger that the warning may indicate. Systems and methods are described herein to enable caretakers to facilitate caretaker interaction with the child's health and safety by using two-way communication through a smart technology system. Implementations of the systems and methods are collectively referred to in this document as a 'smart seat system.' The use of 'smart seat system' should not be taken as limiting to a single implementation.

In some implementations of a smart seat system, the system solves a technical problem of how to communicate information associated with a child's health to a caretaker. To conduct this communication, some implementations will use various sensors to measure biometric data and communicate the significance of that data to the caretaker of that child. Thus, the implementations discussed herein facilitate communication that the child cannot do his or herself.

In some implementations of a smart seat system, the system solves a technical problem of effective alerting to help prevent dangerous situations that may otherwise go unnoticed. For example, a child being left unattended in a hot car. In some implementations, the system deploys a method of improving interaction by the use of effective warnings and alerts by selecting various types of outputs, comparing consequent inputs to the various outputs, and optimizing which outputs produce better facilitate interaction between the system and the child's caretaker, and thus, the health of the child. In other words, the method according to one or more example implementations enables two-way communication between the caretaker of a child and the health of that child.

Implementations of the present application will be described below with reference to the accompanying drawings. It should be understood that the following description is intended to describe exemplary implementations of the application, and not to limit the application.

Figure 1:
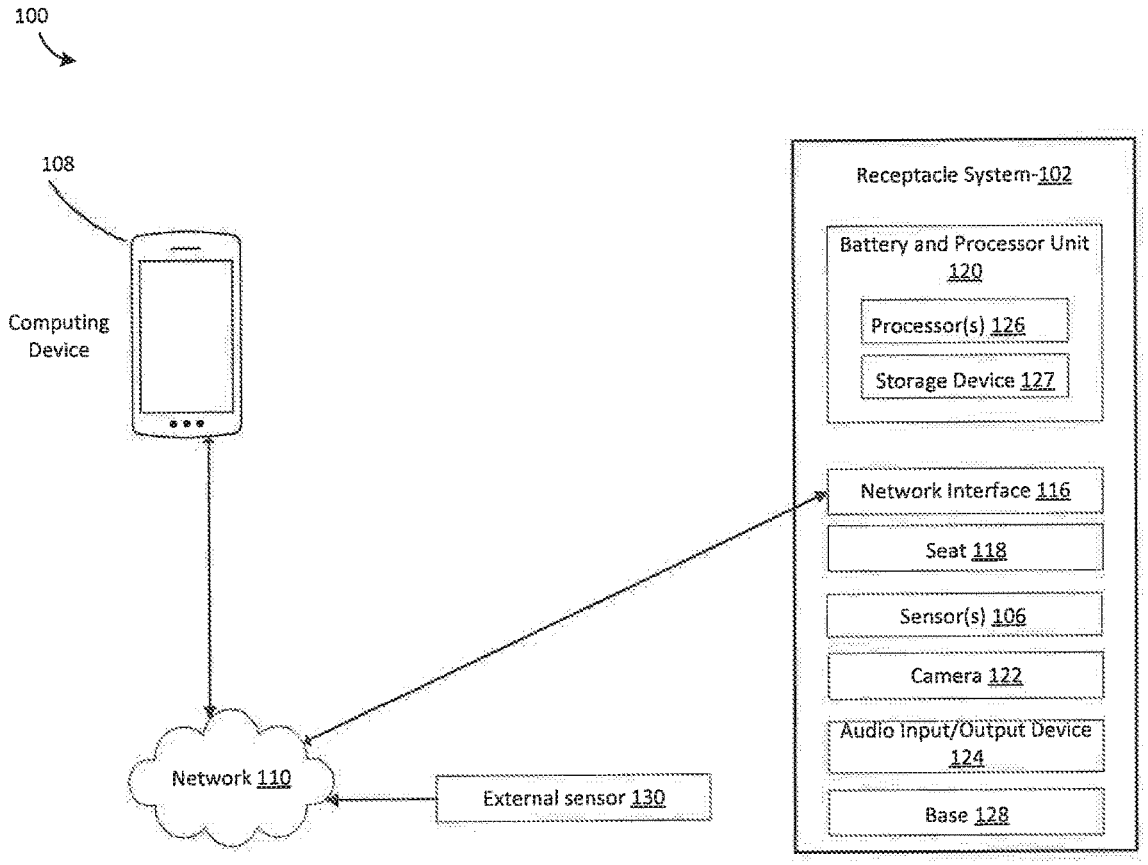
FIG. 1 is a diagram of a smart seat system environment according to an example implementation.

Referring to FIG. 1, the figure depicts an environment 100 comprising an example implementation of the receptacle system 102. The environment 100 comprises a computing device 108 configured to be an interface between the system and the caretaker of a child (the child hereinafter referred to as the "occupant"). The environment 100 includes a receptacle system 102. The receptacle system 102 is also configured to communicate with the computing device 108 via a network 110. The network 110 may include one or more of the Internet, cellular network, Wi-Fi, Wi-Max, or any other type of wired or wireless network or a combination of wired and wireless networks. The network 110 may also use or be by short range communication or network technologies to enable near-field communication or communicate via technologies including Bluetooth® transceivers, Bluetooth® beacons, RFID transceivers, NFC transceivers, Wi-Fi transceivers, cellular transceivers, microwave transmitters, software radio, wired network connections (e.g., Ethernet), etc. The network 110 may also be connected to a local or cloud-based storage device. For example, storage device 127 may be a cloud-based storage device rather than a storage device as part of the battery and processor unit 120. In other implementations, data storage may be shared between a local storage device and a cloud-based storage device. An external sensor 130 connected to the network 110 may include one or more sensors not fixedly coupled to the receptacle system 102. For example, a motion sensor is communicable and fixedly coupled to a vehicle and is configured to sense motion of the occupant in the seat 118 or the vehicle in general. In this instance, the motion sensor is operatively coupled to the smart seat system via network connections in the vehicle. In another example, the external sensor is a sensor coupled to an independent system or to a dependent, ancillary system. That may be a camera, smart home system, or other child monitoring devices. The configuration of these different components enables communication and interaction associated with the health and safety of a child with the caretaker of the child.

Still referring to FIG. 1, according to an example implementation, the receptacle system 102 comprises other components including, as depicted in the figure, a sensor 106, a network interface 116, a seat 118, a battery and processor unit 120, a camera 122, an audio input/output device 124, and a base 128. The seat may be a baby carrying seat, a child booster seat, or another carrying device configured to contain a person. The seat may be configured to be coupled to the battery and processor unit 120. In this instance, the battery and processor unit 120 remains mechanically coupled to the seat 118 when the seat 118 is detached from the base 128. The seat 118 may also be configured to be detachably coupled to the base 128. In other example implementations, the base 128 is configured to be detachably coupled to the battery and processor unit 120.

In the environment 100, data communication between a computing device 108 and a receptacle system 102 may be facilitated by the network 110. In some arrangements, the network 110 includes the internet. In other arrangements or combinations, the network 110 includes a local area network or a wide area network. The network 110 may also comprise, use or be facilitated by short and/or long-range communication technologies including Bluetooth® transceivers, Bluetooth® beacons, RFID transceivers, NFC transceivers, Wi- Fi transceivers, cellular transceivers, microwave transmitters, software radio, wired network connections (e.g., Ethernet), etc.

In some implementations, the audio input/output device 124 is coupled to the receptacle system 102 to be configured to receive and transmit sound waves from the occupant in the seat. In another example implementation, the audio input/output device 124 is configured to receive sound waves from the caretaker of the occupant. In another example implementation, the audio input/output device 124 is configured to transmit sound to the caretaker as an output, as described hereinafter. In some implementations, the camera 122 is coupled to the receptacle system 102 and is configured to take still or video images of the occupant in the seat.

Still referring to FIG. 1, according to an example implementation, the battery and processor unit 120 comprises a rechargeable battery, configured to power the receptacle system 102 independent of power from another source. The battery and processor unit includes a lithium-ion battery, or the like, and one or more processors 126. In one example implementation, the battery and the one or more processors 126 are fixedly coupled to each other. In another example implementation, the battery and one or more processors 126 are not fixedly coupled but are still electrically coupled.

In some implementations, the battery in the battery and processor unit 120 is configured to power the one or more processors 126 and the other components in the receptacle system 102. In one example implementation, the battery and processor unit 120 is configured to be charged by an external power source from a power supply coupled to the base 128. In another example, the battery and processor unit 120 is configured to be supplied electric power from a 12V power supply in a vehicle or a 110V power supply in a home or vehicle. The battery and processor unit 120 is detachably coupled to the base 128. In other examples, the battery and processor unit 120 is detachably coupled to the seat 118.

In some implementations, the one or more processors 126 in the battery and processor unit 120 execute instructions stored in the memory or may execute instructions otherwise accessible to the one or more processors 126. The one or more processors 126 may be constructed in a manner sufficient to perform at least the operations described herein. In some implementations, the one or more processors 126 may be shared by multiple circuits (e.g., circuit A and circuit B may comprise or otherwise share the same processor which, in some example implementations, may execute instructions stored, or otherwise accessed, via different areas of memory). Alternatively or additionally, the one or more processors 126 may be structured to perform or otherwise execute certain operations independent of one or more co-processors. In other example implementations, two or more processors may be coupled via a bus to enable independent, parallel, pipelined, or multi-threaded instruction execution. Each processor may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors 126 may take the form of a single core processor, multi-core processor (e.g., a dual core processor, triple core processor, quad core processor, etc.), microprocessor, etc. In some implementations, the one or more processors 126 may be external to the apparatus, for example the one or more processors 126 may be a remote processor (e.g., a cloud-based processor). Alternatively or additionally, the one or more processors 126 may be internal and/or local to the apparatus. In this regard, a given circuit or components thereof may be disposed locally (e.g., as part of a local server, a local computing system, etc.) or remotely (e.g., as part of a remote server such as a cloud-based server). To that end, "one or more processors" as described herein may include components that are distributed across one or more locations.

Still referring to FIG. 1, according to an example implementation, the network interface 116 includes, for example, hardware and associated program logic that connects the receptacle system 102 to the network 110 to facilitate operative communication with the mobile computing device 108, the external sensor 130, and any external database or computing resources. In some implementations, the network interfaces allow data to pass to and from the network 110 (e.g., the internet). In some implementations, the network interfaces include the hardware and logic necessary to communicate over multiple channels of data communication. For example, they may include an Ethernet transceiver, a cellular modem, a BLUETOOTH transceiver, a BLUETOOTH beacon, an RFID transceiver, and/or an NFC transmitter. Data passing through the network interfaces may be encrypted such that the interfaces are secure communication modules. In yet another example implementation, the network interface may be configured to transmit the location of the receptacle system via a global positioning system. In yet another example, the network interface may be configured to access a database containing health information via the network.

In one example implementation, the network interface 116 includes, for example, hardware and associated program logic that connects the receptacle system 102 to a mobile computing device 108 to facilitate operative communication with the receptacle system 102. In some implementations, the network interfaces allow data to pass to and from the network 110 (e.g., the internet). In some implementations, the network interfaces include the hardware and logic necessary to communicate over multiple channels of data communication. For example, they may include an Ethernet transceiver, a cellular modem, a BLUETOOTH transceiver, a BLUETOOTH beacon, an RFID transceiver, and/or an NFC transmitter. Data passing through the network interfaces may be encrypted such that the interfaces are secure communication modules.

The sensor 106 includes one or more sensors configured to measure and transmit data related to the health and safety of the occupant in the seat 118. In some implementations, the one or more sensors comprises a piezoelectric sensor. A piezoelectric sensor may be configured to convert mechanical forces such as strain, pressure, acceleration, force, or thermodynamic induced strain into an electric charge. Mechanical forces may include a pushing of the piezoelectric sensor from the rising and falling of the chest of an occupant of the seat 118. As such, the change in electrical charges indicates specific breathing patterns. In one example implementation, the sensor is configured to be coupled to a restraint configured to lay across the abdomen or chest of the occupant. An example of a restraint may be a car seat belt or another restraint that is configured to restrain the occupant.

The sensor 106 includes one or more sensors configured to measure and transmit data related to the health and safety of the occupant in the seat 118. In some implementations, the one or more sensors comprises a weight sensor. For example, the weight sensor may be configured as a plurality of piezoelectric sensors, aligned in a grid, embedded in the upholstery in the seat 118. The grid of piezoelectric sensors may be configured to take measurements that result in the determination of the occupant's posture by yielding a measurement on each point of the grid. A collection of these local measurements yields an overall pressure distribution of the occupant across the seat 118. In another example implementation, the weight sensor is a load cell coupled to the seat 118. The weight sensor not only measures the weight and posture of occupant in seat 118, but it also serves as a detector indicating the presence of an occupant in a seat 118. Additionally, the local measurements may be used to indicate that the seat 118 containing the occupant is the incorrect size for the occupant.

The sensor 106 includes one or more sensors configured to measure and transmit data related to the health and safety of the occupant in the seat 118. In some implementations, the one or more sensors comprises a thermometer. In one example implementation, an infrared thermometer is coupled to the seat 118. The thermometer is configured to measure the body temperature of the occupant. In another example implementation, the thermometer is also configured to measure the ambient temperature around the occupant and the receptacle system. In yet another example implementation, the sensor is a negative temperature coefficient resistor configured to measure temperature directly from the skin. In the foregoing example implementations, the sensor may serve the purpose of communicating a temperature indicative of a fever. The sensor may also be configured to indicate a danger to the child in the form of high or low ambient temperature such that the sensor would detect when a child is inadvertently left in a hot or cold vehicle or other confined space.

Still referring to FIG. 1, the computing device 108 is a cellular telephone, computer tablet, laptop, wearable computing device, and the like, according to an example implementation. In some implementations, the computing device 108 further comprises a mobile or web-based application. The application is configured to manage data from the receptacle system 102 and communicate with the network 110. The application is configured to be an interface between the caretaker of the child and the receptacle system 102 monitoring a child's health. The computing device 108 is configured to communicate with the network through the application or the network interface 116.

In some implementations, the computing device 108 includes one or more processors 126 and a storage device 127. The computing device 108 may also include a camera capable of taking still or video pictures. An antenna in the computing device 108 may send and receive wireless signals from sources such as the radio antenna and satellite. The antenna may, in some implementations, communicate directly with the server such as by exchanging wireless signals. The computing device 108 may further comprise other input/output devices, such as a microphone and a speaker used, for example, in an implementation in which the computing device 108 functions as a telephone. The computing device 108 may communicate with a server system via the internet over a network 110. The network may include any one or combination of multiple different types of networks, such as cable networks, local area networks, personal area networks, wide area networks, the Internet, wireless networks, ad hoc networks, mesh networks, and/or the like. In some implementations the satellite and/or the radio antenna may provide network connectivity to the computing device 108 as well as provide geolocation. For example, the radio antenna may provide network access to the computing device 108 according to the International Mobile Telecommunications-2000 standards ("3G network") or the International Mobile Telecommunications Advanced standards ("4G network"). Other implementations may include one source of geolocation data such as the satellite (e.g. GPS) and a separate source of network connectivity such as a Wi-Fi hotspot. The server system may house or otherwise have a connection to multiple data stores including user information and/or other data stores.

Figure 2:
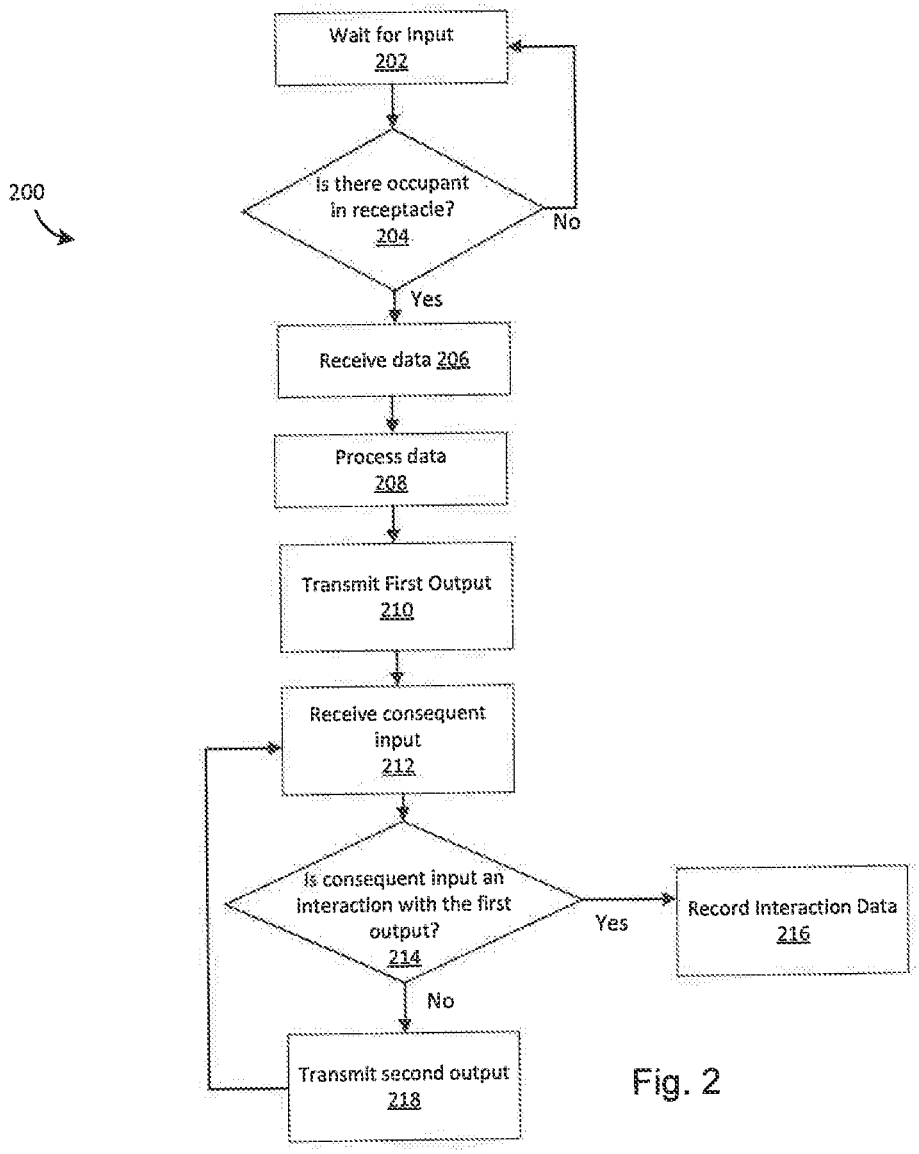
FIG. 2 is a flow diagram of a method of receiving and analyzing communication with a smart seat system according to an example implementation.

Referring now to FIG. 2, a flow diagram of a method 200 of determining and encouraging interaction between a caretaker and the receptacle system 102 is shown, according to an example implementation. In some implementations, the method 200 is performed by the one or more processors 126 of the receptacle system 102. In other implementations, the method is performed by the computing device 108 or by a cloud-based computer accessed via the network 110. The method begins with waiting for an input at 202. In one example implementation, the input may come from a sensor (e.g., sensor 106) in the receptacle system 102. For example, an input is data from the sensor reading biometric data. In another example implementation, the input is an audio input through an audio input/output device (e.g., audio input/output device 124). For example, a user of a receptacle system 102 or an occupant may provide an audio input picked up by a microphone coupled to the receptacle system 102. In yet another example implementation, the input is imagery data from a camera (e.g., camera 122). For example, the camera 122 sending still or moving images is an input. In yet another example implementation, the input is data from the external sensor 130. For example, data indicating movement from an external sensor 130 comprising a motion sensor as an input. In another example, the input is data from the external sensor 130 communicably coupled to the network or the receptacle system 102, such as a car's alarms indicating that a door is closed or open. In that case, the vehicle may be coupled to the network or receptacle system via the network interface 116. In yet another example implementation, the input is data from the external sensor 130 configured to be a smart home system or other child monitoring device. In yet another example implementation, the input is data from the computing device 108. For example, the user of the computing device 108 may request information via a mobile application. The request is considered an input according to an example implementation.

Continuing with the method 200, after receiving an input at 202, a determination is made whether, based on the input, there is an occupant in a seat (e.g., seat 118 or other seating receptacle) at 204, according to an example implementation. If there is an occupant, data is received at 206. If there is no occupant, for further input is awaited at 202. In one example implementation, at 204, the determination of whether there is an occupant in the receptacle is based on an input from a sensor (e.g., sensor 106) indicating an occupant. For example, an input is received from one or more weight sensors detecting an object with weight in the seat and a determination is made that an occupant is in the receptacle. If the weight sensors do not indicate a weight, the method loops back to 202. In another example implementation, the determination is based on an input from one or more thermometers indicating an occupant in the seat. If the thermometers do not register a temperature indicative of an occupant, the method loops back to 202. In yet another example implementation, at 204, the determination is based on an input from one or more cameras 122. For example, an input as a video or still image indicating an occupant. If the cameras do not provide an image that is indicative of an occupant, the method loops back to 202.

Continuing with the method 200, after determining that there is an occupant in the receptacle at 204, data is received at 206. In one example implementation, the data is the same or substantially similar to the input described herein at 202. In another example implementation, the data received at 206 is different data than what was included in the input described herein at 202. In some implementations, the data comprises signals from a sensor (e.g., sensor 106), wherein the sensor is one or more piezoelectric sensors. For example, an occupant may have a strap such as a seat belt across their chest comprising the one or more piezoelectric sensors. As they breathe, the belt is strained by the chest cavity expanding and contracting. Each expansion and contraction induces an electrical charge. The data may be the electrical charges directly or an electrical signal comprising a data stream of information indicative of the electrical charges. The data stream may comprise both a timing of the electrical charges as well as timing gaps where there are no electrical charges.

In other implementations, the data at 206 comprises signals from a sensor (e.g., sensor 106), wherein the sensor is one or more weight sensors, the data comprises signals from the weight sensors. In one example implementation, the grid of piezoelectric sensors in the weight sensors are configured so that the sensor is strained by the weight of the occupant, which converts that strain to an electrical charge. In that case, the signals are electrical charges indicating the weight of an occupant. In another example implementation, the signals from the weight sensors include pressure readings that indicate posture of the occupant. The strain in each sensor in the grid includes electrical charges that comprises data. The data may be the electrical charges directly or an electrical signal comprising a data stream of information indicative of the electrical charges.

In other implementations, the data at 206 comprises signals from a sensor (e.g., sensor 106), wherein the sensor is one or more thermometers. The thermometer may be a digital thermometer configured to measure temperature as a function of electrical properties and measurements in the thermometer. For example, the data comprises a signal indicating the temperature of the occupant in a seat (e.g., seat 118 or other seating receptacle). In another example, the data is a signal indicating the ambient temperature surrounding the occupant in the seat. The data may comprise electrical charges communicating temperature directly or an electrical signal comprising a data stream of information indicative of the electrical charges communicating temperature. The data stream may comprise both a timing of the electrical charges as well as timing gaps where there are no electrical charges.

In other implementations, the data at 206 comprises signals from the external sensor 130. In one example implementation, the data is signals from the external sensor 130, the external sensor being a motion sensor coupled to a door to detect movement. In that case, the signals received indicating movement are data at 206. In another example implementation, the external sensor 130 includes sensors built into another system such as door alarms on a car. In that case, the signals received from the car comprise data. In yet another example implementation, the signals received are electrical signals.

In other implementations, the data at 206 comprises signals from an audio input/output device (e.g., audio input/output device 124). In one example implementation, the data is audio signals from a microphone coupled to the receptacle system 102. In this instance, the occupant may create sounds that are received by the microphone as data at 206. In one example implementation, the data is audio signals caretaker. The audio signal received from the caretaker comprises data. The audio signal may be configured as an electrical signal. The data may be the electrical charges directly or an electrical signal comprising a data stream of information indicative of the electrical charges. The data stream may comprise both a timing of the electrical charges as well as timing gaps where there are no electrical charges.

In other implementations, the data is signals from the camera 122. In one example implementation, the data may be still imagery data collected from a digital camera or an image sensor. In one example implementation, the data is video imagery data collected from a digital camera or an image sensor. In another example implementation, the imagery data collected from the digital camera or image sensor is configured as a compressed image file such as a JPEG or the like. In yet another example implementation, the imagery data collected from the digital camera or image sensor is a configured as an electrical signal. The data may be the electrical charges directly or an electrical signal comprising a data stream of information indicative of the electrical charges indicating an image. The data stream may comprise both a timing of the electrical charges as well as timing gaps where there are no electrical charges.

In other implementations, the data is signals from the computing device 108. In one example implementation, the data is signals from the computing device 108 via the network 110 or proximity communication from the computing device 108. The signal may comprise data indicating an input from the caretaker requesting the receptacle system 102 to provide a specific output. In one example implementation, the data is radio signals comprising a data stream of information indicative of the radio signals. The data stream may comprise both a timing of the radio signals as well as timing gaps where there are no radio signals. In another example, the data is the electrical charges directly or an electrical signal comprising a data stream of information indicative of the electrical charges indicating an image. The data stream may comprise both a timing of the electrical charges as well as timing gaps where there are no electrical charges.

In other implementations, the data is signals from the network 110. For example, the system may receive data from an online database. The database may contain medical information that can be configured to assist in transmitting a first output at 210. In another example implementation, the database may contain information regarding the health of the occupant stored on a storage device on a cloud-based network.

Any of the foregoing implementations, or others not described herein, of receiving the data and the type of data may be used in one or more combinations.

Continuing with method 200, after receiving data at 206, the data is processed at 208. In some implementations, the data is from a sensor (e.g., sensor 106). In some implementations, electrical charges received as data at 206 from the piezoelectric sensor is processed at 208 into a breathing rate of the occupant. In that case, the changes in electrical charges are processed into rising and falling sequences of the occupant's chest over a time interval. Such data is processed into a breathing rate or pattern as processed data at 208.

In one example implementation, the data from a weight sensor, configured as a load cell, is processed from electrical signals into the weight of the occupant. In one example implementation, the data from the weight sensor, configured as the grid of piezoelectric cells, is processed from electrical signals indicating localized strains indicating pressure from the occupant. In that case, similar to the strain measurements in the piezoelectric sensor in the preceding paragraph, the difference in electrical charges amongst the cells in the grid of piezoelectric censors are processed into pressure points indicating the posture of the occupant in a seat (e.g., seat 118 or other seating receptacle). In another example implementation, data as electrical signals from the weight sensor, configured as the grid of piezoelectric cells, is processed to a weight of the occupant based on processing all of the signals into a weight measurement based on a collection of signals as data.

In one example implementation, the data from a thermometer, configured to measure infrared radiation, is processed from radiation measurements into the temperature of the occupant. In another example implementation, the data from a thermometer, configured to measure infrared radiation, is from processed from radiation measurements into the temperature of the ambient space around the occupant. In another example implementation, the data from a negative temperature coefficient resistor, configured to vary resistance as a function of temperature, is processed from the electrical resistance into the temperature of the occupant. In another example implementation, data indicating the temperature of the occupant and data indicating the ambient temperature is processed into data indicating that the occupant is in a dangerously hot or cold space.

In one example implementation, the data from an audio input/output device (e.g., audio input/output device 124) is processed at 208. For example, the data from a microphone, configured to receive sound waves, is processed from sound waves into text, either readable by a computer or the caretaker of the occupant. In another example implementation, the data from a microphone, configured to receive sound waves, is processed from sound waves into a digitally recorded audio file.

In one example implementation, the data from the computing device 108 is processed at 208. For example, the data from a cellular phone, configured to transmit a request for a specific output, is processed from a computer-readable request into a computer-readable command to provide a specific set of information or output. In another example implementation, the data from a cellular phone, configured to transmit health data, is processed from unprocessed data into an output indicating a recommendation, request, or alarm. In yet another example implementation, the foregoing examples are data from other computing devices (e.g., computing device 108) other than a cellular phone such as a computer tablet, notebook, wearable computing device, or the like.

In one example implementation, the data from an external sensor 130 is processed at 208. For example, the data from a motion sensor coupled to a vehicle is processed from a detection of motion into data indicating that the occupant has been left in the vehicle. In another example implementation, the data processed from sensors in a vehicle by the vehicle is processed into data indicating that the occupant has been left in the vehicle. In yet another example implementation, data from an external camera is processed as an image and used to determine if a child was left at home.

Continuing with the method 200, a first output is transmitted at 210 via the network interface 116 to the network 110, according to an example implementation. The first output comprises processed data, as described herein at 208. The first output comprises a visual, audio, or textual as processed data. In one example implementation, the first output is a text message containing any set of processed data from 208 transmitted to the mobile computing device. In another example implementation, the first output is an audio output such as spoken word or a tone containing any set of processed data from 208 transmitted to the mobile computing device 108. In yet another example implementation, the first output is a visual output such as a graph, chart, color coded alert, or another other visual indicator containing any set of processed data from 208. In yet another example implementation, the first output is a set of data processed from 208 transmitted to a storage device on the network (e.g., storage device 127).

Continuing with the method 200, the receptacle system 102 receives a consequent input at 212 to the first output from 210, according to an example implementation. In one example implementation, the consequent input is received via the network interface 116 from the computing device 108, the network 110, or the external sensor 130. In another example implementation, the consequent input is received from the sensor 106, the camera 122, or the audio input/output device 124. The consequent input may be the same or substantially similar type of input at 202 data received at 206 herein described.

Continuing with the method 200, whether the consequent input is an interaction with the first output is determined at 214, according to an example implementation. If the consequent input is an interaction with the first output, the interaction data is recorded at 216. If the consequent input is not an interaction with the first output, a second output is transmitted to improve the interaction between the caretaker or custodian of the occupant in a seat (e.g., seat 118) with the receptacle system 102. In another example implementation, the determination that the consequent input indicates an interaction is based on a predetermined threshold of the character, number, or frequency of the consequent input that assists in the determination. In this instance, the determination of an interaction enables two-way communication between the caretaker or custodian of the occupant and the health of the occupant.

In one example implementation, the determination of an interaction is based on a determination that the first output results in the consequent input being of a character that indicates a response to the first output. For example, if the first output is transmitted to the computing device 108 indicating improper posture of the occupant, and the consequent input is a response in the weight sensor indicating proper posture based on a uniform weight distribution measured by the weight sensor, then the consequent input at is a response indicating an interaction, and the nature and timing of the interactions are recorded to improve future interactions at 216. In another example implementation, the first output is a warning transmitted to the computing device 108 that the ambient temperature around the occupant is at an unsafe level. If the consequent input indicates a temperature that is the same or higher than the unsafe level indicated by the first output, then the consequent input is not a response indicating an interaction, and the nature and timing of the interactions are recorded to improve future interactions at 216.

In one example implementation, the determination of an interaction is based on a determination that the first output results in the consequent input being of a number of consequent inputs indicating a response to the first output. In one example implementation, the first output is a recommendation for a dosage of medicine for the occupant based on the first input that includes a request for the proper dosage from the computing device 108 and biometric data from a sensor (e.g., sensor 106) received at 206 for the purpose of making a recommendation. The consequent input may include an input from the computing device 108 indicating the type of medication administered and an input indicating the time and quantity administrated from the computing device 108. If the number of consequent inputs satisfies the predetermined number threshold of receiving the all of the above inputs, then the consequent input is an interaction, and the nature and timing of the interactions are recorded to improve future interactions at 216. In another example implementation, the first output may be a warning that is transmitted to the computing device 108 indicating that the ambient temperature around the occupant is rising, indicating an uncomfortable temperature in the home or room of the child. The consequent input may be an input from the computing device 108 indicating that the caretaker acknowledges the warning. If a predetermined threshold of satisfactory consequent inputs for a warning of a room being too warm includes an acknowledgment and an input from an external sensor (e.g., external sensor 130) such as a smart home thermostat indicating that the climate control is being adjusted appropriately, then the consequent input does not indicate an interaction, and the nature and timing of the interactions are recorded to improve future interactions.

In one example implementation, the determination of an interaction is based on a determination that the first output results in the consequent input being of a frequency of consequent inputs indicating a response to the first output. For example, the first output is a warning that the occupant's breathing rate is too high or too low, and the consequent input includes data received from the piezoelectric sensor wherein each input is a change in electrical charge measured over time. If the consequent inputs from the piezoelectric sensors are of a frequency that satisfies the predetermined threshold of frequency of inputs indicating proper breathing, then the consequent input is an interaction, and the nature and timing of the interactions are recorded at 216 to improve future interactions. In another example implementation, the first output is a reminder to feed the occupant based on a determined feeding plan, and the consequent input does not include data as an input from the computing device 108 indicating that the occupant has been fed. If the lack of an input confirming that the child is fed is below the threshold frequency of confirmations based on feeding frequency, then the lack of a consequent input is not an interaction, and the nature and timing of the interactions are recorded at 216 to improve future interactions.

In one example implementation, the determination of an interaction is based on input that indicates particular circumstances. For example, the first output is an alert to the computing device 108 containing information that the occupant has been left in a vehicle. If the consequent input includes GPS data indicating that the computing device 108 has changed location without an input indicating that the occupant or seating receptacle (e.g., seat 118) has not left the vehicle, then the consequent input does not indicate an interaction, and the nature and timing of the inputs and outputs are recorded at 216 to improve future interactions. In another example implementation, the first output at is a recommendation that the occupant should be placed for a nap. If there is a predetermined acceptable response such as moving the child to a room or the child being removed from the seat, based on information acquired through previous interactions, and the caretaker instead leaves the child in a different place, then the subsequent input indicating the same location of the child is not an interaction, and the nature and timing of the interactions are recorded at 216 to improve future interactions. In other words, circumstances from previous interactions may be used to determine if a current subsequent input is an interaction.

Continuing with the method 200, interaction data from the determination at 214 is recorded at 216. In one example implementation, the interaction data is recorded on a storage e device (e.g., storage device 127). In other implementations, the data is shared on the network 110 for the purpose of improving interaction methods. In another example implementation, the interaction data recorded at 216 is recorded for the purpose of improving future first outputs. For example, if a certain type of output results in consequent interactions, that data is recorded so that future first outputs at 210 are of the type that yields high levels of interactions.

Continuing with the method 200, a second output is transmitted at 218. The properties of the second output at 218 are based on the determination made at 214, the second output configured as two-way communication to promote more interaction between the system and the occupant's caretaker based on the determination at 214. All of implementations described herein at 218 may be used in combination. In one example implementation, the second output is a different type of output than the first output. After transmitting the second output, a second consequent input to the second output is received, and that second consequent input is evaluated as the first consequent input at 214 was evaluated to determine if the second consequent input is an interaction with the second output. For example, the first output is a text message alert or notification transmitted to the computing device 108, and the second output is a tone or other audio notification transmitted to the computing device 108, vehicle connected to the receptacle system 102, or other connected device for the purpose of facilitating interactions associated with health of a child with the caretaker of the child.

In one example implementation, the second output is transmitted to a different component in the environment 100. For example, a first output is transmitted to the vehicle that the receptacle system 102 is coupled to, according to an example implementation. A second output is transmitted directly to the mobile computing device 108. In another example, a second output is transmitted to multiple components of the environment 100.

In one example implementation, the second output is of a different character than the first output. For example, a first output is a text notification transmitted to the mobile computing device 108. The second output may be a visual chart or graph outputting the same or different information contained in the first output. In another example, the second output containing the visual output may also contain an audio output as well such as a tone.

Figure 3:
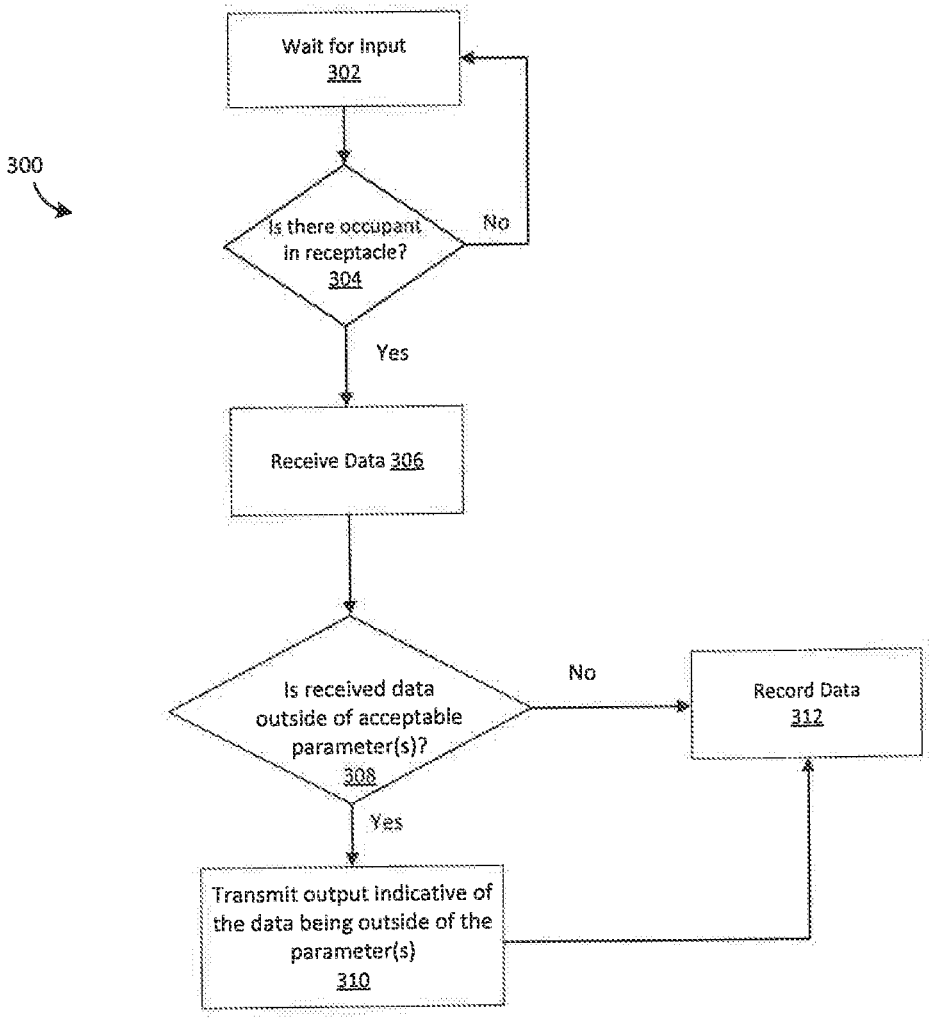
FIG. 3 is a flow diagram of a method for measuring and analyzing received data from a smart seat system according to an example implementation.

Now referring to FIG. 3, a method 300 for determining if a set of analyzed data from the receptacle system 102 is outside of a set of acceptable parameters and outputting a notification that the data is outside the parameters, according to an example implementation. In one example implementation, the method is performed by the one or more processors 126 of the smart seat system. In another example implementation, the method is performed by the computing device 108 or by a cloud-based computer accessed via the network 110. The method begins with waiting for an input at 302, as described herein at 202.

Continuing with the method 300, after receiving an input at 302, a determination is made whether, based on the input, there is an occupant in the seat 118 at 304, according to an example implementation. If there is an occupant, the method then continues to 306. If there is no occupant, the method returns to wait for further input at 302. Some example implementations of the determination are substantially similar to the implementations described herein at 204. However, the present application is not limited to the implementations described herein at 204.

Continuing with the method 300, after a determination that there is an occupant in the receptacle at 304, data is received at 306, according to an example implementation. In one example implementation, the data is the same or substantially similar to the input described herein at 302. In other implementations, the data received at 306 is different data than what was included in the input, as described herein at 302. Some example implementations of receiving data is substantially similar to the implementations described herein at 206. In another example implementation, the data received is processed data, as described herein at 208. However, the present application is not limited to the implementations described herein at 206.

Continuing with the method 300, after data is received at 306, data is analyzed to determine if the received data is outside of acceptable parameters at 308, according to an example implementation. The data may be analyzed by the one or more processors 126, as described herein. The data received may already indicate what parameters the data is applicable to (e.g., the data is an internal body temperature), or the data may be raw data, such as electrical signals described herein at 206. In one example implementation, the data received is temperature data from a thermometer, and the data is analyzed to determine if the temperature is within acceptable parameters, the temperature being either the internal body temperature of the occupant or the ambient temperature surrounding the occupant. For example, a sensor in the receptacle system 102, configured as a thermometer, reads temperature data. The temperature is determined based on the data. The temperature is then analyzed to determine if the temperatures satisfies acceptable parameters for data of that type (e.g., 96-99° F.). If the analysis determines that the received data is within the acceptable parameters, then the data is recorded at 312. If the analysis determines that the received data is not within those acceptable parameters, then an output is transmitted at 310 indicating that the parameters are not being satisfied.

In another example implementation, the data received is data from the piezoelectric weight sensor, and the data is analyzed to determine if the posture of the occupant is within acceptable parameters. For example, a weight sensor comprising a grid of piezoelectric sensors reads pressure induced on the sensor by the occupant at each point on the grid. The pressure measurements are then analyzed to determine if there is an acceptable distribution of weight on the weight sensor (e.g. a grid point measuring pressure outside a standard deviation of pressure readings by a certain determined degree). If the analysis determines that the received data is within the acceptable parameters, then the data is recorded at 312. If the analysis determines that the received data is not within those acceptable parameters, then an output is transmitted at 310 indicating that there are parameters not being satisfied. In this instance, the parameters not being satisfied indicating improper posture.

In another example implementation, the data received is data from an external sensor (e.g., external sensor 130), and the data is analyzed to determine if the occupant has been left alone in a vehicle. For example, an external sensor is operably connected to a vehicle, comprising sensors for determining if the doors of the vehicle are open and if a driver is in the seat. The external sensor measures that there is no driver in the car and the door has been opened and closed. Also, the weight sensor, as described in the preceding paragraph, measures no occupant in the receptacle in the vehicle. The data is analyzed to determine if the data is outside a parameter indicating that a child has been left in the vehicle (e.g. doors opening, no driver, and an occupant in the seat). If the analysis determines that the received data is within the acceptable parameters, then the data is recorded at 312. If the analysis determines that the received data is not within those acceptable parameters, then an output is transmitted at 310 indicating that there are parameters not being satisfied. In this instance, the parameters not being satisfied indicating improper posture.

Any of the foregoing implementations, or others not described herein, of determining if received data is outside of acceptable parameters may be used in one or more combinations.

Continuing with the method 300, after determining that the data received is outside of acceptable parameters at 308, an output is transmitted indicating that the data is outside of the acceptable parameters, according to an example implementation. In one example implementation, similar to one example implementation described at 308, an output indicating that the occupant was left in a vehicle may be transmitted to the caretaker's mobile computing device (e.g., computing device 108). In another example implementation, similar to one example implementation described at 308, an output indicating that the occupant has improper posture may be transmitted through an audio input/output device (e.g., audio input/output device 124) configured to notify the driver/caretaker that the occupant needs to be adjusted in his/her receptacle.

Continuing with the method 300, after determining that the data received is within acceptable parameters at 308, or transmitting the output at 310, data is recorded at 312, according to an example implementation. In one example implementation, the data is recorded on a storage device (e.g., storage device 127). In another example implementation, the data is shared on the network 110 for the purpose of modifying or improving parameters used at 308. In another example implementation, the data recorded comprises the received data at 306 and the analysis at 308.

Figure 4:
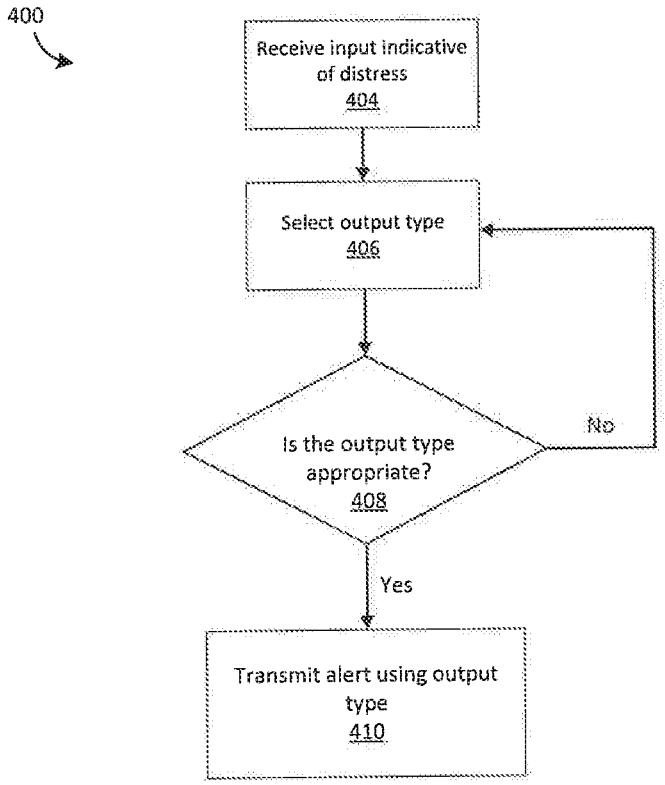
FIG. 4 is a flow diagram of a method selecting an output type for transmitting alerts according to an example implementation.

Now referring to FIG. 4, a method 400 for communicating that an occupant is in distress and selecting an effective output to communicate the distress is shown, according to an example implementation. In some implementations, the method may comprise method steps from the method 300. In one example implementation, the method is performed by the one or more processors 126 of the receptacle system 102. In other implementations, the method is performed by the computing device 108 or by a cloud-based computer accessed via the network 110. The method begins with waiting for an input at 402, as described herein at 202.

Continuing with the method 400, an input is received indicative of distress at 404. The input may be the same input/data received in the method 300. Distress is defined as an occupant being in a condition that is hazardous to his or her health and safety. Examples of distress, as defined herein, include, but are not limited to, being in a hot car, being in a body position that may inhibit breathing, having bad posture, and being in unknown situations that are communicated by verbal cues from the child. In one example implementation, the input indicating distress is from a sensor, configured as a thermometer, indicating that the occupant's internal body temperature is rising. In another example implementation, the input is a sound input from an audio input/output device (e.g., audio input/output device 124), configured as a microphone on the seat 118, indicating that the occupant is in distress, such as a baby crying. In yet another example implementation, in input indicating distress is from a sensor, configured as a piezoelectric sensor, indicating that the occupant is not breathing.

Continuing with the method 400, after receiving an input indicative of distress at 404, an output type is selected. The types may include visual, audio, or textual outputs. In one example implementation, the first output is a textual output configured as a text message or notification to a mobile computing device (e.g., computing device 108). In another example implementation, the output is an audio output such as spoken word or a tone. In another example implementation, the output is a visual output such as a graph, chart, color coded alert, or another visual indicator. In another example implementation, the output is a set of data processed.

Continuing with the method 400, after selecting an output type at 406, it is determined whether the output type is the appropriate type at 406. In an example implementation, the appropriate output type is based selecting the output at random. In another example implementation, the type of output selected is based on determinations of outputs that result in high levels of interactions based on the determination made at 214, as recorded at 216. In this instance, effective output types that result in high levels of interaction is the appropriate output type. For example, if interaction data recorded at 216 indicates that the caretaker responds to reminders to feed the occupant with text notifications, the proper output type for a reminder to feed at 408. In another example implementation, the output type is appropriate based on the nature of the input received. For example, if the input indicates that a child is in distress because he or she has been left in a hot car, the appropriate output type may be a loud audio alarm coupled with a visual output to the screen of the user's mobile computing device (e.g., computing device 108), regardless of previous interactions data. In this instance, the urgency of remedying the distress being a primary factor in determining if the output type is appropriate.

Continuing with the method 400, after determining that the output type is the appropriate type, an alert is transmitted using the output type selected and deemed appropriate. The alert is configured to be transmitted with an output type appropriate to promote relief of the distress indicated in the input at 404. The alert may be transmitted in any manner described herein in the method 200.

The implementations of the present application have been described with reference to drawings. The drawings illustrate certain details of specific implementations that implement the systems, methods, and programs of the present application. However, describing the application with drawings should not be construed as imposing on the application any limitations that may be present in the drawings. The present application contemplates methods and systems on any machine-readable media for accomplishing its operations. The implementations of the present application may be implemented using an existing computer processor, or by a special purpose computer processor incorporated for this or another purpose or by a hardwired system.

As noted above, implementations within the scope of the present application include methods and systems comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions comprise, for example, instructions and data which cause a general purpose computer, special purpose computer, or special purpose processing machines to perform a certain function or group of functions.

Implementations of the present application have been described in the general context of method steps which may be implemented in one implementation by a program product including machine-executable instructions, such as program code, for example in the form of program modules executed by machines in networked environments. Generally, program modules include routines, programs, objects, components, data structures, etc. that perform particular tasks or implement particular abstract data types. Machine-executable instructions, associated data structures, and program modules represent examples of program code for executing steps of the methods disclosed herein. The particular sequence of such executable instructions or associated data structures represent examples of corresponding acts for implementing the functions described in such steps.

As previously indicated, implementations of the present application may be practiced in a networked environment using logical connections to one or more remote computers having processors. Those skilled in the art will appreciate that such network computing environments may encompass many types of computers, including personal computers, hand-held devices, multi-processor systems, microprocessor-based or programmable consumer electronics, network PCs, minicomputers, mainframe computers, and so on. Implementations of the application may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

An example system for implementing the overall system or portions of the application might include computers including a processing unit, a system memory, and a system bus that couples various system components including the system memory to the processing unit. The system memory may include read only memory (ROM) and random access memory (RAM). The computer may also include a magnetic hard disk drive for reading from and writing to a magnetic hard disk, a magnetic disk drive for reading from or writing to a removable magnetic disk, and an optical disk drive for reading from or writing to a removable optical disk such as a CD ROM or other optical media. The drives and their associated machine-readable media provide nonvolatile storage of machine-executable instructions, data structures, program modules and other data for the computer. It should also be noted that the word "terminal" as used herein is intended to encompass computer input and output devices. Input devices, as described herein, include a keyboard, a keypad, a mouse, joystick or other input devices performing a similar function. The output devices, as described herein, include a computer monitor, printer, facsimile machine, or other output devices performing a similar function.

It should be noted that although the diagrams herein may show a specific order and composition of method steps, it is understood that the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative implementations. Accordingly, all such modifications are intended to be included within the scope of the present application as defined in the appended claims. Such variations will depend on the software and hardware systems chosen and on designer choice. It is understood that all such variations are within the scope of the application. Likewise, software and web implementations of the present application could be accomplished with standard programming techniques with rule based logic and other logic to accomplish the various database searching steps, correlation steps, comparison steps and decision steps.

The foregoing description of implementations of the application has been presented for purposes of illustration and description. It is not intended to be exhaustive or to limit the application to the precise form disclosed, and modifications and variations are possible in light of the above teachings or may be acquired from practice of the application. The implementations were chosen and described in order to explain the principals of the application and its practical application to enable one skilled in the art to utilize the application in various implementations and with various modifications as are suited to the particular use contemplated. Other substitutions, modifications, changes and omissions may be made in the design, operating conditions and arrangement of the implementations without departing from the scope of the present application as expressed in the appended claims.

What is claimed is:

1. A method for operating a seating receptacle comprising:

receiving, by one or more processors, an input indicative of an occupancy of a seating receptacle;

receiving, by the one or more processors, data from a sensor coupled to the receptacle, wherein the sensor is one of a microphone, a camera, a weight sensor, a respiration sensor, or a thermometer;

transmitting, by the one or more processors to a computing device of a user interacting with the seating receptacle, an output of a first output type based on the received data from the sensor;

receiving, by the one or more processors and from the computing device, a first input consequent to transmitting the output of the first output type;

comparing, by the one or more processors, a number or frequency of inputs including the first input consequent to transmitting the first output to a threshold number or frequency of inputs;

determining, by the one or more processors, the number or frequency of inputs including the first input does not meet the threshold number or frequency of inputs; and transmitting, by the one or more processors and to the computing device, an output of a second output type based on the determination, wherein the second output type is different than the first output type.

2. The method of claim 1, further comprising:

receiving, by the one or more processors and from the computing device, a second input consequent to transmitting the second output type;

comparing, by the one or more processors, a number or frequency of inputs responsive to outputs of the second output type including the second input to the threshold number of inputs; and determining, by the one or more processors, the number or frequency of inputs responsive to outputs of the second output type including the second input meets the threshold number of inputs.

3. The method of claim 2, further comprising:

determining, by the one or more processors, the data is indicative of distress of an occupant of the seating receptacle; and transmitting, by the one or more processors and to the computing device, an alert using the second output type consequent to determining the number or frequency of inputs responsive to outputs of the second output type including the second input meets the threshold number of inputs.

4. The method of claim 1, further comprising:

accessing, by the one or more processors, an online database;

comparing, by the one or more processors, the received data to data from the accessed online database; and determining, by the one or more processors, an occupant of the seating receptacle is potentially in distress based on the comparison.

5. The method of claim 1, further comprising:

comparing, by the one or more processors, the received data to a predetermined parameter;

determining, by the one or more processors, the received data is outside of the predetermined parameter; and outputting, by the one or more processors and to the computing device, a signal indicative of an alert based on the determination.

6. A non-transitory computer-readable medium comprising instructions, wherein the instructions executing on one or more processors of a receptacle seating system of executes a method comprising:

receiving an input indicative of an occupancy of a seating receptacle;

receiving data from a sensor coupled to the receptacle, wherein the sensor is one of a microphone, a camera, a weight sensor, a respiration sensor, or a thermometer;

transmitting, to a computing device of a user interacting with the receptacle seating, an output of a first output type based on the received data from the sensor;

receiving, from the computing device, a first input consequent to transmitting the output of the first output type;

comparing a number or frequency of inputs including the first input consequent to transmitting the first output to a threshold number or frequency of inputs;

determining the number or frequency of inputs including the first input does not meet the threshold number or frequency of inputs; and transmitting, to the computing device, an output of a second output type based on the determination, wherein the second output type is different than the first output type.

7. The medium of claim 6, the method further comprising:

receiving, from the computing device, a second input consequent to transmitting the second output type;

comparing a number or frequency of inputs responsive to outputs of the second output type including the second input to the threshold number of inputs; and determining the number or frequency of inputs responsive to outputs of the second output type including the second input meets the threshold number of inputs.

8. The medium of claim 7, the method further comprising:

determining the data is indicative of distress of an occupant of the seating receptacle; and transmitting, from the computing device, an alert using the second output type consequent to determining the number or frequency of inputs responsive to outputs of the second output type including the second input meets the threshold number of inputs.

9. The medium of claim 6, the method further comprising:

accessing an online database;

comparing the received data to data from the accessed online database; and determining an occupant of the seating receptacle is potentially in distress based on the comparison.

10. The medium of claim 6, the method further comprising:

comparing the received data to a predetermined parameter;

determining the received data is outside of the predetermined parameter; and outputting, to the computing device, a signal indicative of an alert based on the determination.

11. A system comprising:

a seating receptacle;

a piezoelectric sensor configured to sense respiration;

a weight sensor configured to sense posture;

a memory containing instructions;

a network interface; and one or more processors, when executing the instructions, cause the one or more processors to:

receive an input indicative of an occupancy of the seating receptacle;

receive data from the piezoelectric sensor and the weight sensor;

transmit an output of a first output type based on the received data using the network interface;

receive a first input, from the network interface and from a computing device of a user interacting with the seating receptacle, consequent to transmitting the output of the first output type;

compare a number or frequency of inputs including the first input consequent to transmitting the first output to a threshold number or frequency of inputs;

determine the number or frequency of inputs including the first input does not meet the threshold number or frequency of inputs;

transmit an output to the computing device of a second output type based on the determination the number or frequency of inputs including the first input does not meet the threshold number or frequency of inputs, wherein the second output type is different than the first output type;

receive a second input, from the network interface and from the computing device, consequent to transmitting the output of the second output type;

compare the number or frequency of inputs responsive to outputs of the second output type including the second input to the threshold number of inputs;

determine the number or frequency of inputs responsive to outputs of the second output type including the second input meets the threshold number of inputs, receive additional data from at least one of the piezoelectric sensor or the weight sensor;

determine the additional data is indicative of distress of an occupant of the seating receptacle; and transmit an alert to the computing device, using the network interface and using the second output type, consequent to determining the number or frequency of inputs responsive to outputs of the second output type including the second input meets the threshold number of inputs and consequent to determining the additional data is indicative of distress of the occupant of seating receptacle.

* * * * *